US010262531B2

(12) United States Patent
Evans

(10) Patent No.: US 10,262,531 B2
(45) Date of Patent: Apr. 16, 2019

(54) METHOD FOR CONTROLLING TRAFFIC FLOW AND STRUCTURE THEREFOR

(71) Applicant: Eberle Design, Inc., Phoenix, AZ (US)

(72) Inventor: Scott Richard Evans, Gilbert, AZ (US)

(73) Assignee: Eberle Design, Inc., Phoenix, AZ (US)

( * ) Notice: Subject to any disclaimer, the term of this patent is extended or adjusted under 35 U.S.C. 154(b) by 0 days.

(21) Appl. No.: 15/730,458

(22) Filed: Oct. 11, 2017

(65) Prior Publication Data

US 2018/0137755 A1 May 17, 2018

Related U.S. Application Data

(60) Provisional application No. 62/422,465, filed on Nov. 15, 2016.

(51) Int. Cl.
*G08G 1/095* (2006.01)
*G08G 1/097* (2006.01)
*G08G 1/0962* (2006.01)

(52) U.S. Cl.
CPC ..... *G08G 1/095* (2013.01); *G08G 1/097* (2013.01); *G08G 1/09623* (2013.01)

(58) Field of Classification Search
CPC ..... G08G 1/00; G08G 1/07; G08G 1/095; G08G 1/09623; G06K 9/00818; G06K 9/00825
See application file for complete search history.

(56) References Cited

U.S. PATENT DOCUMENTS 3,629,802 A * 12/1971 Clark ..... G08G 1/097 340/931
4,135,145 A * 1/1979 Eberle ..... G08G 1/097 340/642
4,383,240 A * 5/1983 Staats, Jr. ..... G08G 1/097 315/132
2005/0110660 A1* 5/2005 Jacobs ..... G08G 1/005 340/944
2005/0138488 A1* 6/2005 Jacobs ..... G08G 1/097 714/56
2010/0039794 A1* 2/2010 Ghanem ..... G08G 1/095 362/20

* cited by examiner

*Primary Examiner* — Van T Trieu

(57) ABSTRACT

In accordance with an embodiment, a method for controlling a traffic signal includes providing a malfunction management unit configured to generate a control signal and generating the control signal in response to a first signal from a first light source. The control signal is used to disable the first light source. In accordance with another embodiment, a traffic control system includes a malfunction management unit coupled to a first signal head. The traffic control system further includes a means to inhibit a signal that causes a first light source associated with the first signal head to flash.

20 Claims, 7 Drawing Sheets

70-1
70-2
76
76RH
76RS
76RL
76YH
76YS
76YL
76GH
76GS
76GL
76R1
76Y1
76G1
76R2
76Y2
76G2
72R1
72Y1
72G1
72R2
72Y2
72G2
56R1
56R2
10B
50B
FLASH TRANSFER RELAY
53
52
46B1
46B2
54
52
64
FLASHER
60
46A
80
71R1
71Y1
71G1
48R2
48Y2
48G2
48R1
48Y1
48G1
38R2
38R1
38Y1
38Y2
38G1
38G2
39
MMU
FLASH SIGNAL DETECTION MODULE
41
40
OUTPUT ASSEMBLY
36
36m
362
361
30
32
16
18
CONTROLLER
12
14
28
INPUT ASSEMBLY
20
26
26n
262
261
VIN
22

METHOD FOR CONTROLLING TRAFFIC FLOW AND STRUCTURE THEREFOR

BACKGROUND

The present invention relates, in general, to traffic control devices and, more particularly, to signal monitors and traffic control signals.

A traffic control assembly may include a flasher, a flash transfer relay, and a signal monitor and is used to control traffic at intersections. The signal monitor is a device used in the traffic control assembly to detect and respond to conflicting or otherwise improper signals. Such improper signals may arise, for example, due to field signal conflicts, a malfunctioning controller, faulty load switches, cabinet miswiring, improper supply voltages, and the like. The flasher is a device in the traffic control assembly that delivers power to the selected light source when operating in a flashing mode and flash transfer relays are used to switch the source of the traffic signal power from load switches to the flasher. When one or more failures occur, the signal monitor instructs (or causes other components to instruct) the signal lights to enter a "flash" mode, in which the traffic lights on all sides of the intersection generally enter a flashing red state or a flashing yellow state.

Accordingly, it would be advantageous to have improved signal monitor systems and methods that may diminish the possibility of vehicle operators encountering contradictory signals at, for example, an intersection in flash mode. It would be of further advantage for the signal monitor system and method to be cost efficient to implement.

BRIEF DESCRIPTION OF THE DRAWINGS

The present invention will be better understood from a reading of the following detailed description, taken in conjunction with the accompanying drawing figures, in which like reference characters designate like elements and in which.

Figure 1:
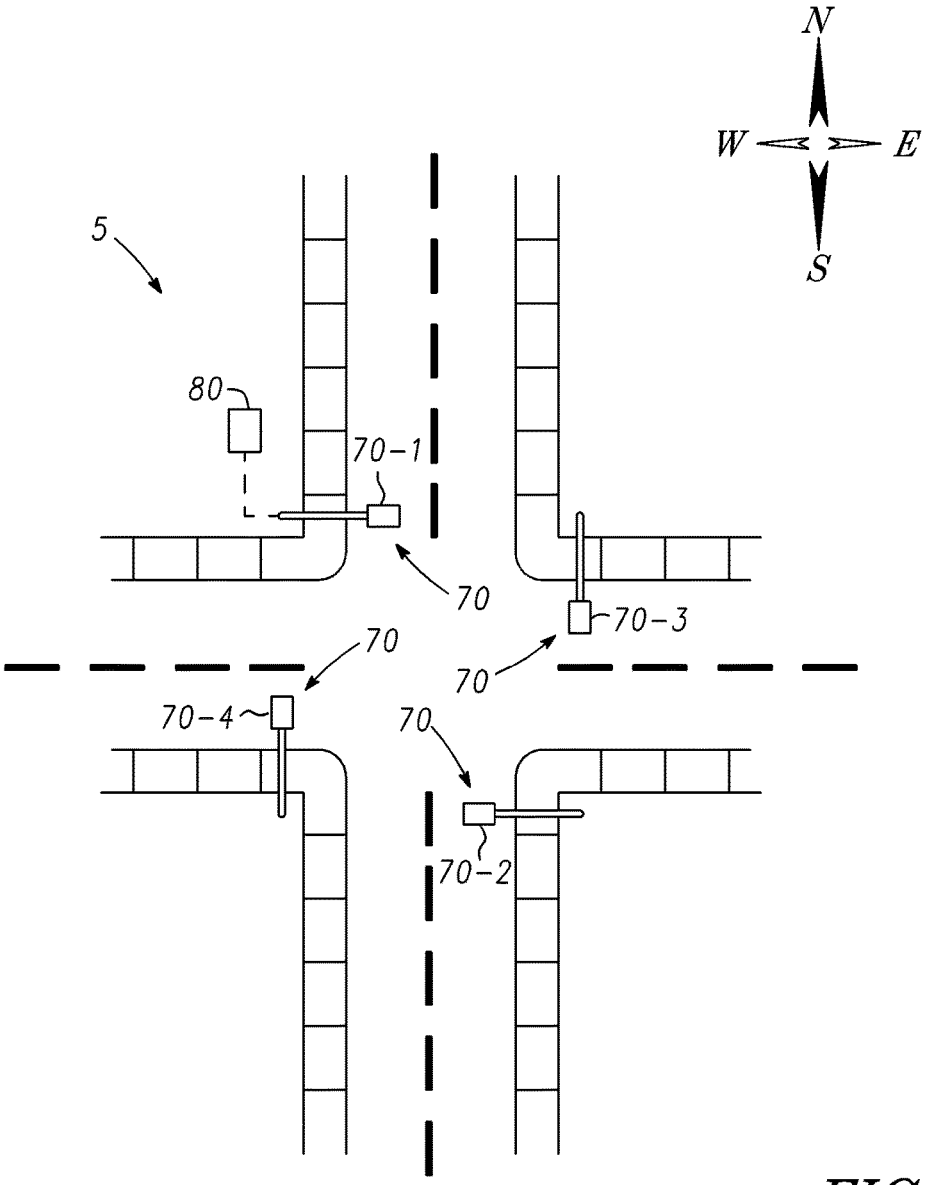
FIG. 1 is a top view of an intersection in accordance with an embodiment of the present invention.

It will be appreciated by those skilled in the art that the words during, while, and when as used herein are not exact terms that mean an action takes place instantly upon an initiating action but that there may be some small but reasonable delay, such as a propagation delay, between the reaction that is initiated by the initial action and the initial action. The use of the word approximately, about, or substantially means that a value of an element has a parameter that is expected to be very close to a stated value or position. However, as is well known in the art there are always minor variances that prevent the values or positions from being exactly as stated. For simplicity and clarity of illustration, the drawing figures depict the general topology, structure and/or manner of construction of the various embodiments.

Descriptions and details of well-known features and techniques may be omitted to avoid unnecessarily obscuring other features. For example, conventional techniques and components related to traffic control devices are not described in detail herein. Elements in the figures are not necessarily drawn to scale: the dimensions of some features may be exaggerated relative to other elements to assist in understanding the example embodiments.

Terms of enumeration such as "first," "second," "third," and the like may be used for distinguishing between similar elements and not necessarily for describing a particular spatial or chronological order. These terms, so used, are interchangeable under appropriate circumstances. The embodiments of the invention described herein are, for example, capable of use in sequences other than those illustrated or otherwise described herein. Unless expressly stated otherwise, "connected," if used herein, means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically.

The terms "comprise," "include," "have" and any variations thereof are used synonymously to denote non-exclusive inclusion. The terms "left," "right," "in," "out," "front," "back," "up," "down," and other such directional terms are used to describe relative positions, not necessarily absolute positions in space. The term "exemplary" is used in the sense of "example," rather than "ideal."

DETAILED DESCRIPTION

Generally, the present invention relates to systems and methods for controlling traffic at an intersection. In response to a traffic control system entering the flash mode, a traffic control device coupled to the traffic control system flashes a red light in all directions controlled by the traffic light. In accordance with an embodiment, if any two light sources of the traffic light are flashing simultaneously or substantially simultaneously, the traffic control system generates a control signal that causes the traffic light to display a predetermined light pattern. For example, the predetermined light pattern may be that all the lights are turned off or all the red lights or all the yellow lights are turned on. It is desirable to configure the light emission state of the light sources to mitigate the possibility of accidents in the intersection.

FIG. 1 is a top view of a four-way intersection 5 controlled by an intersection cabinet 80. In the example shown in FIG. 1, cabinet 80 controls four signal heads 70. To distinguish signal heads 70, the signal head at the north location of intersection 5 is identified by reference character 70-1, the signal head at the south location of intersection 5 is identified by reference character 70-2, the signal head at the east location of intersection 5 is identified by reference character 70-3, and the signal head at the west location of intersection 5 is identified by reference character 70-4. By way of example, signal heads 70-1 and 70-2 may control traffic flow in a north-south direction and signal heads 70-3 and 70-4 may control traffic flow in an east-west direction. Cabinet 80 houses a traffic control system, e.g., traffic control systems 10, 10A, 200, or 10B of FIGS. 2, 4, 5, and 6, respectively, and traffic control system 10B of FIG. 7, that control signal heads 70-1, 70-2, 70-3, and 70-4. For the sake of clarity, FIG. 1 only shows the connection between the traffic control system housed by cabinet 80 and signal head 70-1 of the plurality of signal heads 70. It should be noted that the traffic control system housed in cabinet 80 may communicate with signal heads 70-1, 70-2, 70-3, and 70-4 via metal cables, fiber optic cables, via wireless communications, or the like. It should be noted that the number of signal heads connected to cabinet 80 is not limited to four. There may be one, two, three, four, or more signal heads connected to cabinet 80.

Figure 2:
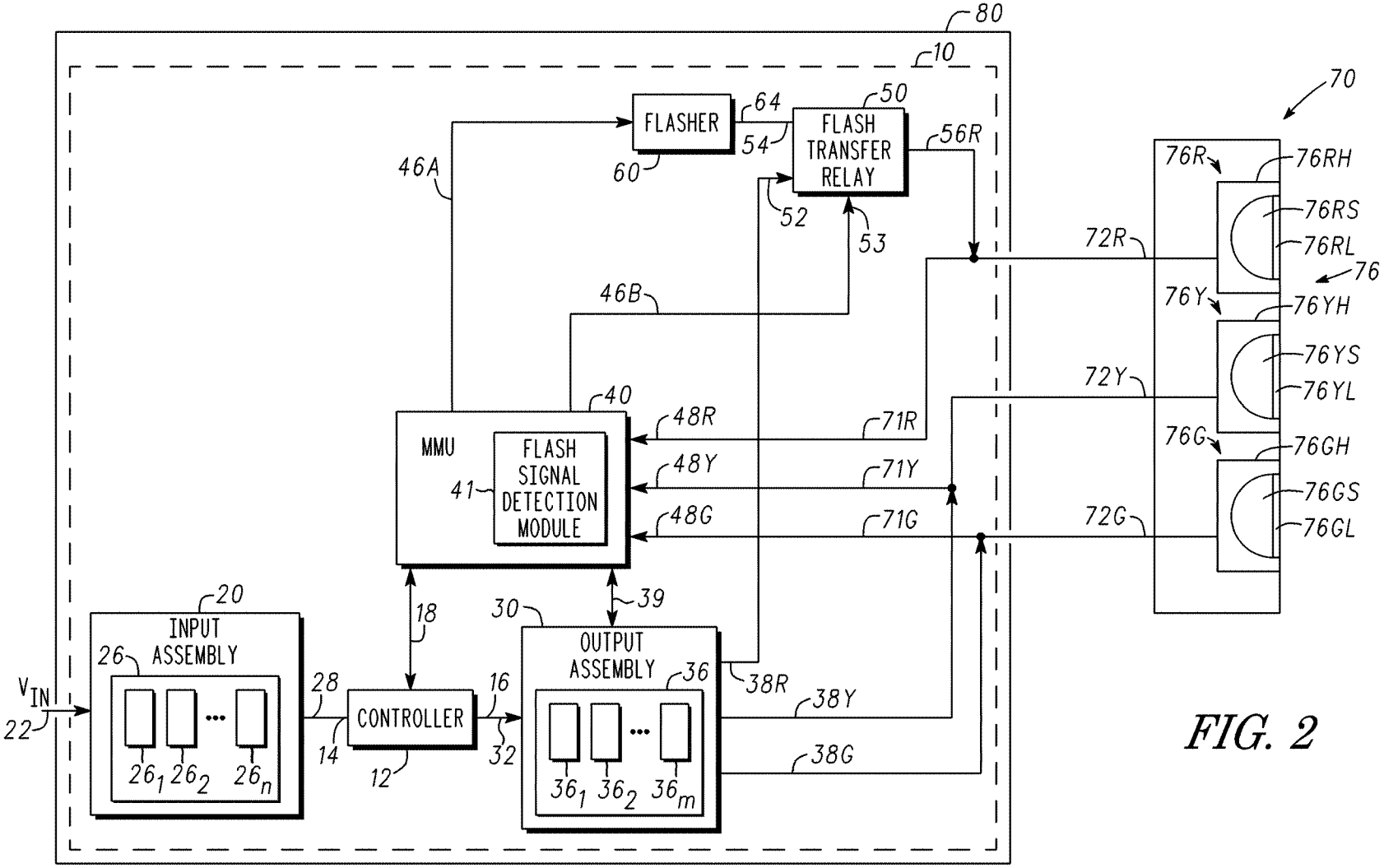
FIG. 2 is a circuit diagram of a traffic control system in accordance with an embodiment of the present invention.

FIG. 2 is a block diagram of a traffic control system 10 connected to a signal head 70 in accordance with an embodiment of the present invention. Traffic control system 10 may be referred to as an intersection control system. Signal head 70 includes a signal face 76 that is comprised of signal sections 76R, 76Y, and 76G. Signal section 76R may be an assembly comprising a signal housing 76RH, a signal lens 76RL, and a light source 76RS that emits light of a predetermined color such as, for example, red light; signal section 76Y may be an assembly comprising a signal housing 76YH, a signal lens 76YL, and a light source 76YS that emits light of a predetermined color such as, for example, yellow light; and signal section 76G may be an assembly comprising a signal housing 76GH, a signal lens 76GL, and a light source 76GS that emits light of a predetermined color such as, for example, green light. It should be noted that a signal head may be an assembly comprised of one or more signal faces that are configured to control traffic movement on one or more approaches; a signal housing is the part of the signal section that protects the light source from mechanical or environmental stresses; and the signal section may be an assembly that is comprised of the signal housing, the signal lens, and the light source. It should be further noted that the signal lens may be an optional component that redirects the light coming directly from the light source. Although a single signal head is shown, this is not a limitation and there may be one or more signal heads at an intersection as shown in FIG. 1.

FIG. 2 further illustrates that traffic control system 10 may be comprised of a controller 12, an input assembly 20, an output assembly 30, a Malfunction Management Unit ("MMU") 40, a flash transfer relay 50, and a flasher 60. One or more signal heads 70 may be connected to traffic control system 10. The number of signal heads connected to traffic control system 10 is not a limitation. Intersection 5 shown in FIG. 1 is an embodiment in which four signal heads are connected to traffic control system 10. Traffic control system 10 may be mounted in an intersection cabinet 80, wherein intersection cabinet 80 provides protection from physical stresses such as automobiles striking one or more elements of control system 10, animals nesting in or on elements of intersection control system 10, vandals, or the like. In addition, intersection cabinet 80 may provide protection from environmental stresses such as rain, snow, ice, wind, heat, exposure to sunlight, or the like. Intersection cabinet 80 may be referred to as a cabinet, an enclosure, a protective structure, etc.

Input assembly 20 has an input terminal 22 coupled for receiving an input signal $V_{IN}$, an array 26 of input devices, and an output terminal 28. Array 26 of input devices may be comprised of one or more vehicle detectors $\mathbf{26}_1$, $\mathbf{26}_2$, . . . , $\mathbf{26}_n$, where n is an integer that may be 1, 2, 3, etc. By way of example, array 26 is comprised of an array of vehicle detectors configured to receive input signals $V_{IN}$ from an intersection environment through embedded inductive loops or other such sensors.

Controller 12 has an input terminal 14 connected to output terminal 28 of input assembly 20 and an output terminal 16 connected to an input terminal 32 of output assembly 30. In addition, controller 12 is connected to MMU 40 through a bi-directional communications connection 18 such as a single wire communications bus. Output assembly 30 includes an array 36 of load switches comprising one or more load switches $\mathbf{36}_1$, $\mathbf{36}_2$, . . . , $\mathbf{36}_m$, where m is an integer that may be 1, 2, 3, etc. A bi-directional communications connection 39 connects output assembly 30 to MMU 40. By way of example, bi-directional communications connection 39 is a single wire bidirectional communications bus. Communications busses such a single wire communications busses or multi-wire communications busses may be referred to as busses.

Output assembly 30 is connected to input 52 of flash transfer relay 50 through a single channel unidirectional communications connection 38R, which may be a single wire communications bus. Output assembly 30 is connected to input 72Y of signal section 76Y through a single channel unidirectional communications connection 38Y and to an input 48Y of MMU 40 through single channel unidirectional communications connection 38Y and a single channel unidirectional communications connection 71Y. Output assembly 30 is connected to input 72G of signal section 76G through a single channel unidirectional communications connection 38G and to an input 48G of MMU 40 through single channel unidirectional communications connection 38G and single channel unidirectional communications connection 71G. Single channel unidirectional communications connections may be referred to as single channel unidirectional communications busses or single channel communications busses. Array 36 may communicate with the environment via an output terminal to effect traffic control via activation of the appropriate traffic signal. In this example, controller 12 communicates with and controls the various assemblies within cabinet 80. The present invention is not limited to specific controller units or communication protocols.

MMU 40 is configured to detect and respond to conflicting or otherwise improper signals caused by a malfunctioning controller 12, faulty load switches such as, for example, load switches $\mathbf{36}_1$, $\mathbf{36}_2$, . . . , $\mathbf{36}_m$, cabinet mis-wiring, improper supply voltages, or other such faulty mechanisms. MMU 40 may be configured as a 6-channel monitor, a 12-channel monitor, a 16-channel monitor, a 32-channel monitor, etc. Inputs 48R, 48Y, and 48G of MMU 40 form a channel. The number of channels for MMU 40 is not a limitation of the present invention. Likewise, the number of signal heads connected to MMU 40 is not a limitation of the present invention. A traffic intersection may have one, two, three, four, or more signal heads connected to MMU 40. It should be noted that an MMU may be referred to as a signal monitor, a conflict management unit, or the like.

The general functional requirements of conventional MMU's are covered by a variety of standards including, for example, National Electrical Manufacturers Association ("NEMA") TS2-2016; Traffic Control Systems AASHTO/ITE/NEMA Intelligent Transportation Systems ("ITS"); Standard Specification for Roadside Cabinets, v 01.02.17b; and Caltrans Transportation Electrical Equipment Specifications ("TEES"), August 2009. In this regard, MMU's are often referred to in terms of which standards to which they conform, including, for example, NEMA TS-2 signal monitors, NEMA TS-1 signal monitors, 2010 signal monitors, 210 signal monitors, ITS signal monitors, etc. It will be appreciated that the present invention is not limited to any particular standard or type of signal monitor.

In accordance with an embodiment, MMU 40 includes a flash signal detection module 41 which may be comprised of any suitable combination of hardware, software, and/or non-transitory computer-readable media configured to detect the occurrence of at least two light sources from signal sections 76R, 76Y, and 76G being active or on at the same time or no signal sections 76R, 76Y, and 76G being active. Two or more light sources from signal sections 76R, 76Y, and 76G being active at the same time, e.g., simultaneously, may occur, for example, because of physical shorting of single channel unidirectional communications busses 71R, 71Y, and 71G to input terminals 72R, 72Y, and 72G of signal sections 76R, 76Y, and 76G. The short circuit can occur either inside or outside of cabinet 80.

MMU 40 may be configured such that it receives and processes signals from output assembly 30 and controller 12. In this way, MMU 40 provides "field checking." That is, MMU 40 is capable of determining the output of load switches $\mathbf{36}_1$, $\mathbf{36}_2$, . . . , $\mathbf{36}_m$ while at the same time monitoring what controller 12 has instructed those outputs to be.

MMU 40 is connected to a flasher 60 through a single channel unidirectional communications bus 46A and to input 53 of flash transfer relay 50 through a single channel communications bus 46B.

In conventional MMU designs, when one or more failures occurs, the MMU instructs or, more generally, causes other components to instruct the signal sections to enter the flash mode, in which the signal head or signal heads at all sides of the intersection generally enters a flashing red state. More particularly, flash transfer relay 50 is instructed directly by MMU 40 to configure a traffic control device, such as, for example, signal head 70 to enter the flash mode.

Flash transfer relay 50 has an input 54 connected to an output 64 of flasher 60 through a single channel unidirectional communications bus. In addition, flash transfer relay 50 has an output 56R connected to input 72R of signal section 76R through a single channel unidirectional communications bus and to input 48R of MMU 40 through a single channel unidirectional communications bus and through single channel unidirectional communications bus 71R. Thus, a control signal may be transmitted from the output of flasher 60 through flash transfer relay 50 to MMU 40 through single channel unidirectional communications bus 71R and to signal section 76R through a single channel unidirectional communications bus.

Figure 3:
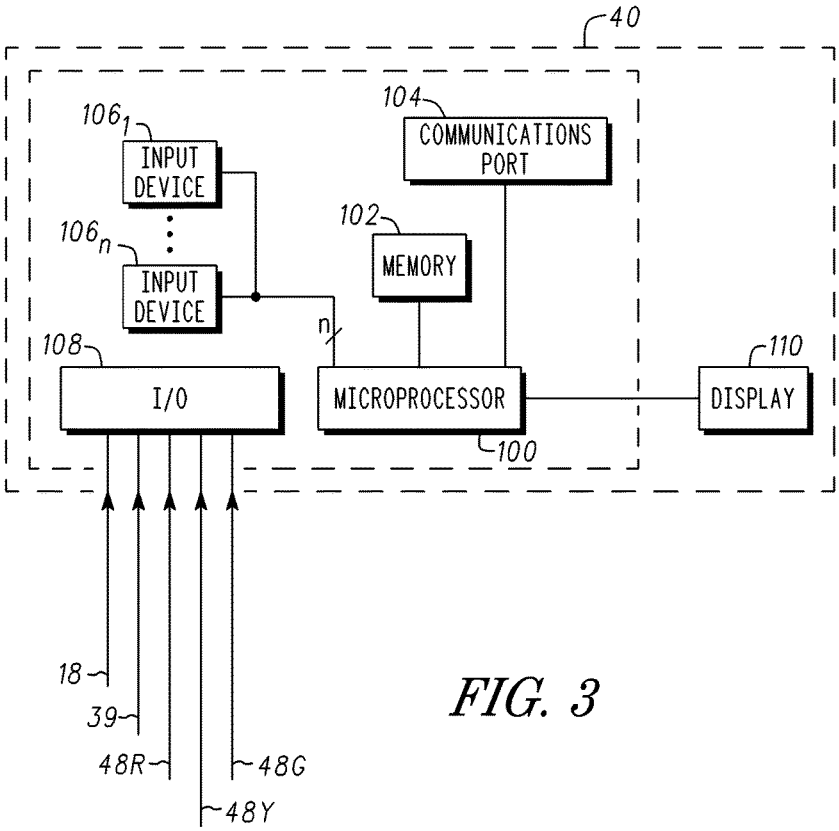
FIG. 3 is schematic block diagram of a malfunction management unit ("MMU") in accordance with an embodiment of the present invention.

FIG. 3 is a block diagram of an MMU such as, for example, MMU 40 in accordance with an embodiment of the present invention. What is shown in FIG. 3 is a microprocessor 100 connected to a memory 102, a user communications port 104, one or more input devices $\mathbf{106}_1$, . . . , $\mathbf{106}_n$, an I/O module 108, and a display 110. Memory 102 may include Random Access Memory ("RAM"), Read Only Memory ("ROM"), Electrically Erasable Programmable Read Only Memory ("EEPROM"), a combination thereof, or the like. As mentioned above, the one or more input devices may include keypads, keyboards, mice, touchpads, etc. It should be noted that other electronic components may be present in MMU 40 and that microprocessor 100, memory 102, user communications port 104, the one or more input devices $\mathbf{106}_1$, . . . , $\mathbf{106}_n$, and I/O module 108 may be part of or may be configured as a microcontroller.

Display 110 may be comprised of one or more display components capable of displaying information pertinent to the operation of traffic control system 10. In this regard, display 110 may include one or more displays of any type now known or developed in the future, including without limitation, Liquid Crystal Displays ("LCDs"), Light Emitting Diode ("LED") displays, electroluminescent displays, and the like. Similarly, such displays may be general purpose, pixel-based displays or custom displays with dedicated display components ("icon-based"), or a combination thereof.

Display 110 may be an interactive display in which its display content is responsive to input devices $\mathbf{106}_1$, . . . , $\mathbf{106}_n$, e.g., one or more buttons, touch screen signals, or any form of direct or indirect input. The size, shape, geometry, or configuration of inputs and outputs are not limitations of the present invention. It should be noted that intersection control system 10 may be implemented in a device that has an external user interface coupled wirelessly or via a wired connection through which the operable features of MMU 40 may be programmed rather than a display or input device.

I/O module 108 includes a bus terminal that is connected to or, alternatively, serves as single wire bidirectional communications bus 18 of MMU 40; a bus terminal that is connected to or, alternatively, serves as single wire bidirectional communications bus 39 of MMU 40; an input terminal that is connected to or, alternatively, serves as input terminal 48R; an input terminal that is connected to or, alternatively, serves as input terminal 48Y; and an input terminal that is connected to or, alternatively serves as input terminal 48G. By way of example, I/O module 108 communicates via single wire bidirectional communications bus 18 with controller 12 (shown in FIG. 2); via single wire bidirectional communications bus 39 with load switches $\mathbf{36}_1$, $\mathbf{36}_2$, . . . , $\mathbf{36}_m$ of output assembly 30; and via input terminals 48R, 48Y, and 48G to signal sections 76R, 76Y, and 76G, respectively, of signal head 70. In addition, MMU 40 may be configured to report the occurrence of a fault condition to an external server or other entity via a communications port 104. It should be noted that the nature of the physical interface between controller 12 and MMU 40 may vary depending on the specific hardware and applicable standards being used.

Communications port 104 may be configured to allow an operator to upload various configuration settings, e.g., settings related to the interrelationship of the various phases of the intersection, which are suitably stored in a memory such as, for example, memory 102. This port may implement any suitable protocol and may include any convenient connector technology.

Figure 4:
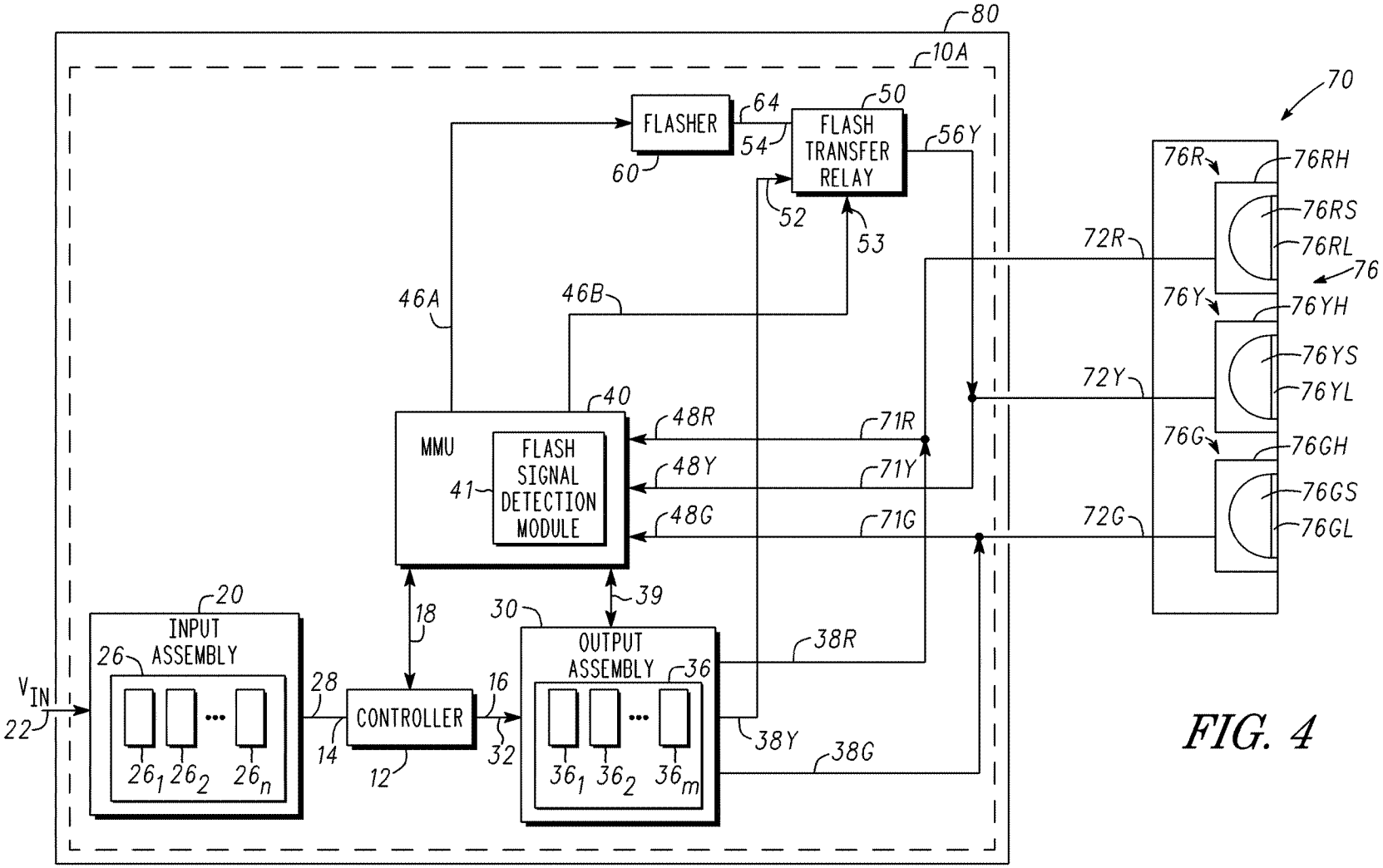
FIG. 4 is a circuit diagram of a traffic control system in accordance with an embodiment of the present invention.

FIG. 4 is a block diagram of a signal head 70 coupled to a traffic control system 10A in accordance with another embodiment of the present invention. Like, traffic control system 10, traffic control system 10A may be referred to as an intersection control system. Traffic control system 10A differs from traffic control system 10 in that: output assembly 30 is connected to input 52 of flash transfer relay 50 through a single channel unidirectional communications connection 38Y, which may be a single wire communications bus; output assembly 30 is connected to input 72R of signal section 76R through a single channel unidirectional communications connection 38R and to an input 48R of MMU 40 through single channel unidirectional communications connection 38R and through single channel unidirectional communications connection 71R; and flash transfer relay 50 has an input 54 connected to an output 64 of flasher 60 through a single channel unidirectional communications bus, and an output 56Y connected to input 72Y of signal section 76Y through a single channel unidirectional communications bus and to input 48Y of MMU 40 through a single channel unidirectional communications bus and through single channel unidirectional communications bus 71Y. Thus, a control signal may be transmitted from the output of flasher 60 through flash transfer relay 50 to MMU 40 through single channel unidirectional communications bus 71Y and to signal section 76Y through a single channel unidirectional communications bus.

In operation, MMU 40 monitors signals from signal sections 76R, 76Y, and 78G from signal head 70 and is configured to generate one or more control signals for controlling whether signal lights 76RL, 76YL, or 76GL from signal sections 76R, 76Y, or 76G, respectively, transmit light. More particularly, MMU 40 may monitor a signal from signal section 76R using input terminal 48R and, for example, a volt meter connected to input 72R of signal section 76R, a signal from signal section 76Y using input terminal 48Y and, for example, a volt meter connected to input 72Y of signal section 76Y, and a signal from signal section 76G using input terminal 48G and, for example, a volt meter connected to input 72G of signal section 76G. MMU 40 may monitor an operating signal selected from the group of signals comprising a current signal, a voltage signal, a power signal, an optional load current signal, a thermal signal, or the like.

Flash signal detection module 41 of MMU 40 is configured to detect whether the light signal sources are flashing properly and to detect a signal from signal head 70 that indicates whether two or more light sources 76RS, 76YS, and 76GS in a signal head 70 are flashing and providing conflicting driving instructions to a vehicle operator approaching a traffic intersection or whether two or more light sources in more than a single signal head are flashing and providing conflicting driving instructions to a vehicle operator approaching a traffic intersection. The signal from signal head 70 may be referred to as an operating signal and is typically a voltage signal. For the sake of clarity a single signal head is illustrated in FIG. 2. Flash signal detection module 41 of MMU 40 is configured to monitor the light sources from a signal head 70. Thus, MMU 40 monitors the status of each light source of a signal head 70 at an intersection.

It should be noted that flasher 60 continuously generates a flasher output signal, but during operation in a non-flashing mode, flash transfer relay 50 is configured such that a signal from flasher 60 is not transmitted to signal head 70. In flash mode, the flasher output signal is transmitted to flash transfer relay 50, which causes one or more light sources in signal head 70 to flash. During flash mode, MMU 40 generates a control signal that is transmitted through single channel communications bus 46B to input 53 of flash transfer relay 50 that configures flash transfer relay 50 to transmit the signal from flasher 60 to signal head 70, causing a light source of a signal head to flash continuously. The control signal may be referred to as a flash transfer relay enable signal. By way of example, MMU 40 generates a control signal that causes red light source 76RS of signal section 76R, yellow light source 76YS of signal section 76Y, or green light source 76GS of signal section 76G to flash for traffic control system 10 of FIG. 2.

In response to flash signal detection module 41 detecting that two or more of light sources 76RS, 76YS, and 76GS from a single signal head 70 are flashing and providing conflicting traffic control instructions, flash signal detection module 41 generates a control signal that is transmitted through single channel communications bus 46A to flasher 60 to configure flasher 60 to disable (turn off) its output signal or to block transmission of the signal from flasher 60 to at least one of light sources 76RS, 76YS, and 76GS of signal head 70, i.e., to inactivate at least one of light sources 76RS, 76YS, and 76GS. This causes one or all of light source 76RS, 76YS, and 76GS to stop emitting an output signal, which results in the light sources associated with one or all of the signal sections 76R, 76Y, and 76G going dark. That is, the control signal disables light sources 76RS, 76YS, and 76GS or stops them from flashing or transmitting light. Disabling light sources 76RS, 76YS, or 76GS sets signal head 70 in an inactive state. In accordance with embodiments in which the control signal generated by MMU 40 stops a light source from flashing, it may be referred to as a disable signal because it disables an output of flasher 60. It should be noted that flasher 60 is shown as having a single output driving a single flash transfer relay for the sake of clarity. However, a traffic control system such as, for example, traffic control system 10 typically includes a flasher and a plurality of flash transfer relays, where the flasher, like flasher 60, typically has multiple outputs driving multiple flash transfer relays.

It should be further noted that the condition wherein two or more of light sources 76RS, 76YS, and 76GS from a single signal head 70 are flashing or whether two or more light sources in two or more signal heads are flashing and displaying conflicting driving instructions may occur because of a short or an open in the signal lines from cabinet 80 to signal head 70, damage to cabinet 80 in response to an external shock such as an automobile accident, a lightning strike, water damage, etc.

In accordance with an example, MMU 40 may be configured to generate the disable control signal in response to a signal head, such as signal head 70, flashing green light source 76GS and yellow light source 76GS, where the light signal from green light source 76GS is flashing in error.

In another example, MMU 40 may be configured to generate the disable control signal in response to a single signal head, such as signal head 70, flashing red light source 76RS and flashing yellow light source 76YS which produces an extra yellow signal.

In another example, MMU 40 may be configured to generate the disable control signal in response to a single signal head, such as signal head 70, flashing red light source 76RS and flashing green light source 76GS which produces an extra green signal.

It should be noted that MMU 40 may be configured to generate the disable control signal in response to two light sources being enabled simultaneously, where the two light sources can be in any direction and producing conflicting traffic control instructions.

In accordance with another embodiment in which flash signal detection module 41 determines that two or more of the light sources of signal head 70 are flashing or operating in a flash mode, MMU 40 generates a control signal that is transmitted through single channel communications bus 46A to flasher 60 that disables flasher 60, causing the light source or light sources that are flashing to go dark, i.e., stop flashing, displaying, or transmitting light. More particularly, flash signal detection module 41 of MMU 40 detects a signal from signal head 70 that indicates whether one of light sources 76RS, 76YS, and 76GS is flashing. Thus, MMU 40 monitors the status of each light source of a signal head 70. In response to flash signal detection module 41 detecting that two or more of light sources 76RS, 76YS, and 76GS are flashing in a single signal head 70, flash signal detection module 41 generates a control signal that is transmitted through single channel communications bus 46A to flasher 60 causing it to stop emitting an output signal, which results in the light sources associated with the signal sections 76R, 76Y and 76G going dark, i.e., to disable light sources 76RS, 76YS, and 76GS or stop them from flashing, displaying, or transmitting light. Disabling light sources 76RS, 76YS, and 76GS sets head 70 in an inactive state. In accordance with embodiments in which the control signal generated by MMU 40 stops a light source from flashing, it may be referred to as a disable signal because it disables the output of flash transfer relay 50.

Figure 5:
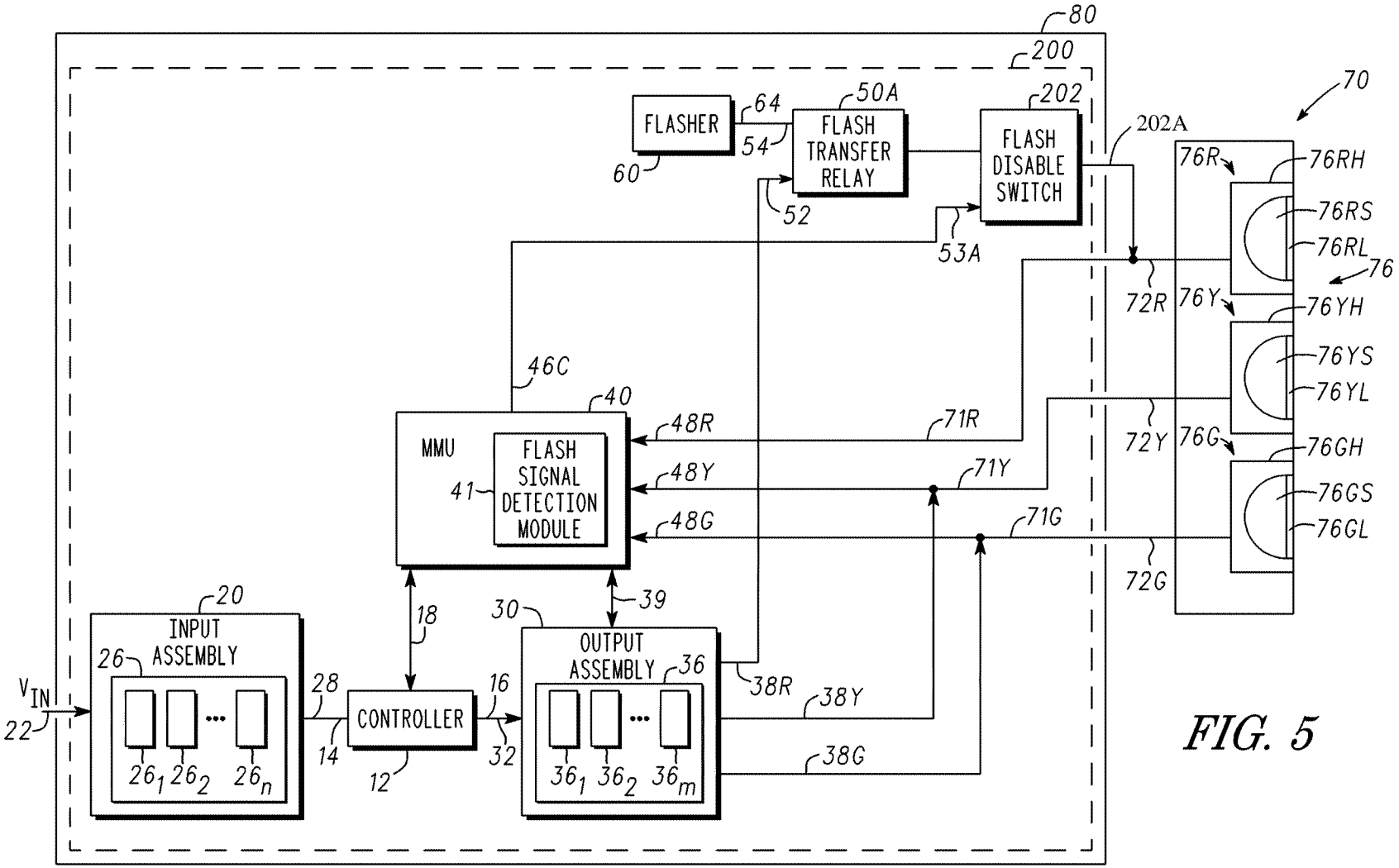
FIG. 5 is a circuit diagram of a traffic control system in accordance with an embodiment of the present invention.

FIG. 5 is a block diagram of a traffic control system 200 connected to a signal head 70 in accordance with another embodiment of the present invention. Like traffic control system 10, traffic control system 200 includes a controller such as, for example, controller 12 shown in FIG. 2; an input assembly such as, for example, input assembly 20 shown in FIG. 2; an output assembly such as, for example, output assembly 30 shown in FIG. 2; an MMU such as, for example, MMU 40 shown in FIGS. 2 and 3; a flasher such as, for example, flasher 60 shown in FIG. 2; and one or more flash transfer relays such as flash transfer relay 50A. In addition, traffic control system 200 includes a flash disable switch 202 having an input 53A connected to an output of MMU 40 via a single channel communications bus 46C, an input electrically connected to an output of flash transfer relay 50A, and an output 202A electrically connected to input terminal 72R of signal section 76R through a single channel unidirectional communications bus. Although output 202A is shown as being connected to input terminal 72R, this is not a limitation of the present invention. For example, output 202A may be connected to input 72Y or to input 72G. It should be noted that there may x flash transfer relays and x flash disable switches, where x is the number of channels. Thus, each individual flash disable switch "x" would be connected to a red light source, a yellow light source, a green light source, or no light source. Typically, a flash disable switch is not connected to a green light source, but for the sake of generality, this connection may be made. Traffic control system 200 may be referred to as an intersection control system.

In operation, MMU 40 monitors signals from signal sections 76R, 76Y, and 78G and is configured to generate a control signal that controls flash disable switch 202. More particularly, MMU 40 monitors the signal at input 72R of signal section 76R using, for example, a volt meter; monitors the signal at input 72Y of signal section 76R using, for example, a volt meter; and monitors the signal at input 72G of signal section 76G using, for example, a volt meter. MMU 40 may monitor an operating signal selected from the group of signals comprising a current signal, a voltage signal, a power signal, an optional load current signal, a thermal signal, or the like. As discussed above, flasher 60 continuously generates a flasher output signal but during operation in a non-flashing mode flash disable switch 202 is configured such that a signal from flasher 60 is not transmitted to signal head 70, e.g., flash disable switch 202 is configured as an open switch or to be in an open state. In flash mode, the flasher output signal is transmitted to flash transfer relay 50, and MMU 40 transmits a control signal to flash disable switch 202 so that it is configured to be a closed switch (or in a closed state) so that the output signal from flasher 60 is transmitted to signal head 70, which causes one of the light sources in signal head 70 to flash or display light signals. During flash mode, MMU 40 generates an enable signal that is transmitted through single channel unidirectional communications bus 46C to input 53A of flash disable switch 202. In response to the enable signal, flash disable switch 202 is configured to transmit the signal from flasher 60 to signal head 70, which causes a light source of a signal head to flash continuously or to continuously display a flashing or blinking light signal. By way of example, MMU 40 generates a control signal that causes red light source 76RS of signal section 76R to flash for traffic control system 200 of FIG. 5 or that causes yellow light source 76YS of signal section 76Y to flash for traffic control system 200 of FIG. 5.

In response to flash signal detection module 41 detecting that two or more of light sources 76RS, 76YS, and 76GS from a single signal head 70 are flashing and displaying conflicting traffic signal control instructions or that two or more light sources in two or more signal heads are flashing and displaying conflicting traffic control instructions, flash signal detection module 41 generates a control signal that is transmitted through a single channel unidirectional communications bus 46C to flash disable switch 202, which disables or opens flash disable switch 202 thereby stopping or terminating the transmission of the output signals from two or more flashers, i.e., the control signal configures flash disable switch 202 to disable a signal to one or more light sources from the signal head. Thus, the light sources associated with signal head 70, e.g., sections 76R, 76Y, and 76G go dark, i.e., light sources 76RS, 76YS, and 76GS are disabled or prevented from flashing, blinking, or transmitting light. In accordance with embodiments in which the control signal generated by MMU 40 stops a light source from flashing, it may be referred to as a disable signal because it opens and closes flash disable switch 202.

In alternative embodiments, the output of flash disable switch 202 may be connected to signal section 76Y, or the output of flash disable switch 202 may be connected to signal section 76G rather than to signal section 76R. In additional alternative embodiments, flash disable switch 202 may include an output 202A connected to signal section 76Y and another output connected to signal section 76G; or flash disable switch 202 may include outputs connected to signal sections 76R, 72Y, and 76G. It should be noted that typically a flash disable switch is not connected to a green light source, e.g., signal section 76G, but for the sake of generality, this connection is included.

Thus, in accordance with an embodiment of FIG. 5, flash signal detection module 41 of MMU 40 detects a signal from a single signal head 70 indicating that one of light sources 76RS, 76YS, and 76GS is flashing. Accordingly, MMU 40 monitors the status of each light source 76RS, 76YS, and 76GS of signal head 70. In response to flash signal detection module 41 of MMU 40 detecting that two or more of the light sources of single signal head 70 are flashing, flash signal detection module 41 generates a disable signal that is transmitted to flash disable switch 202 to cause light sources 76RS, 76YS, and 76GS to go dark, i.e., to stop flashing or transmitting light. By way of example, the disable signal opens flash disable switch 202.

In accordance with an embodiment in which the output of flash disable switch 202 is electrically connected to signal section 76Y rather than to signal section 76R, flash signal detection module 41 generates a disable signal that is transmitted to flash disable switch 202 causing light source 76YS to go dark.

In accordance with an embodiment in which the output of flash disable switch 202 is electrically connected to signal section 76G rather than to signal section 76R, flash signal detection module 41 generates a disable signal that is transmitted to flash disable switch 202 causing light source 76GS to go dark.

In accordance with an embodiment in which the output of flash disable switch 202 is electrically connected to signal sections 76R, 76Y, and 76G, flash signal detection module 41 generates disable signals that are transmitted to flash disable switch 202 causing light sources 76RS, 76YS, and 76GS to go dark.

Figure 6:
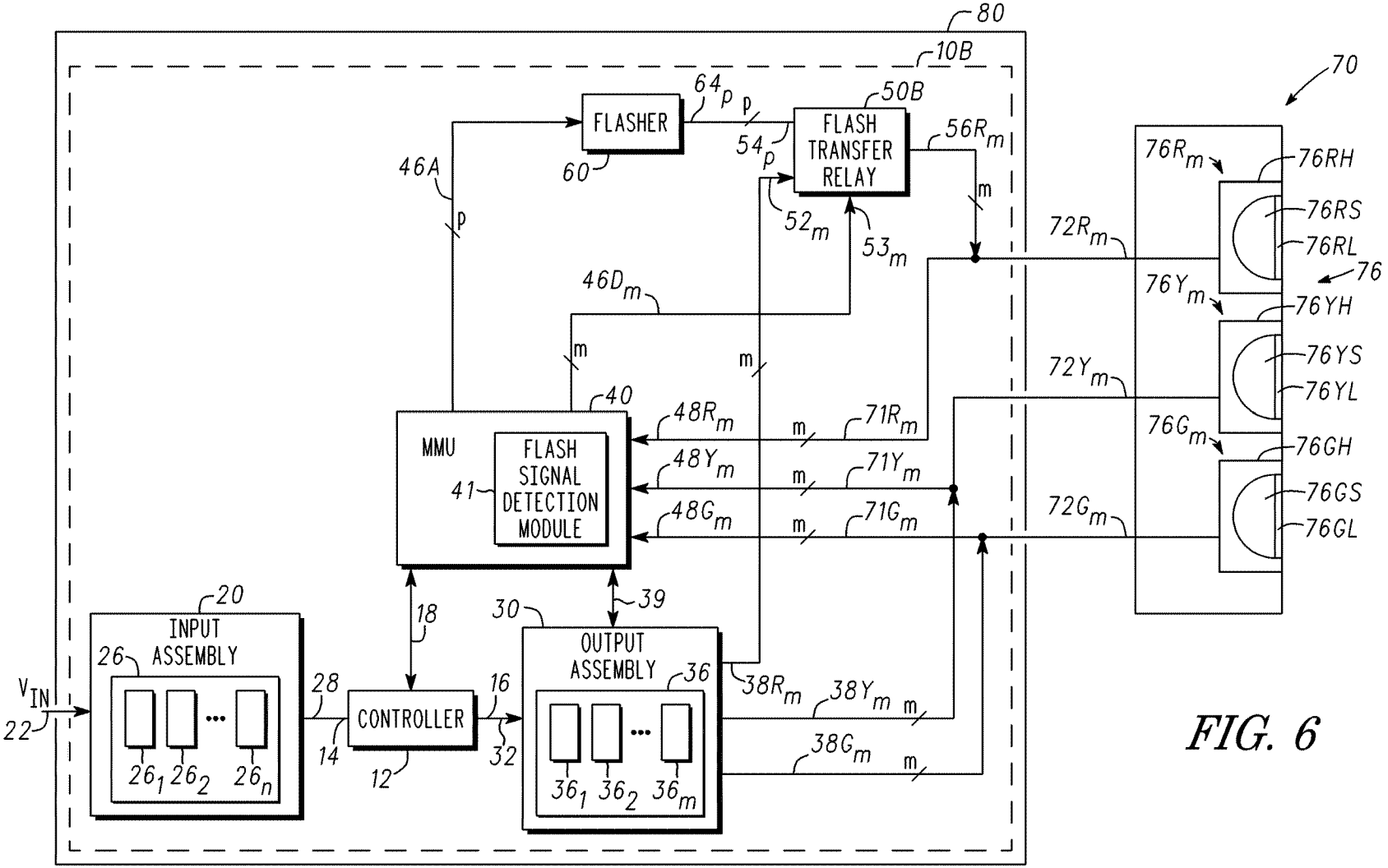
FIG. 6 is a circuit diagram of a traffic control system in accordance with an embodiment of the present invention.

FIG. 6 is a block diagram of a traffic control system 10B connected to one or more signal heads 70 in accordance with an embodiment of the present invention. It should be noted that traffic control system has been described as having single channel unidirectional communications buses or single channel bidirectional communications buses, but that a traffic control system is not limited to these configurations. Traffic control system 10B may be comprised of multi-channel unidirectional communications buses and multi-channel bidirectional communications buses. Traffic control system 10B may be referred to as an intersection control system. Signal heads 70 have been described with reference to FIGS. 1 and 2.

FIG. 6 further illustrates that traffic control system 10B may be comprised of a controller 12, an input assembly 20, an output assembly 30, a Malfunction Management Unit ("MMU") 40, a flash transfer relay 50, and a flasher 60. One or more signal heads 70 may be connected to traffic control system 10B. The number of signal heads connected to traffic control system 10B is not a limitation. Intersection 5 shown in FIG. 1 is an embodiment in which four signal heads are connected to traffic control system 10B. Traffic control system 10B may be mounted in an intersection cabinet 80, wherein intersection cabinet 80 provides protection from physical stresses such as automobiles striking one or more elements of control system 10B, animals nesting in or on elements of intersection control system 10B, vandals, or the like. In addition, intersection cabinet 80 may provide protection from environmental stresses such as rain, snow, ice, wind, heat, exposure to sunlight, or the like. Intersection cabinet 80 may be referred to as a cabinet, an enclosure, a protective structure, etc.

Input assembly 20 has an input terminal 22 coupled for receiving an input signal $V_{IN}$, an array 26 of input devices, and an output terminal 28. Array 26 of input devices may be comprised of one or more vehicle detectors $\mathbf{26}_1$, $\mathbf{26}_2$, . . . , $\mathbf{26}_n$, where n is an integer that may be 1, 2, 3, etc. By way of example, array 26 is comprised of an array of vehicle detectors configured to receive input signals $V_{IN}$ from an intersection environment through embedded inductive loops or other such sensors.

Controller 12 has an input terminal 14 connected to output terminal 28 of input assembly 20 through a multi-channel unidirectional communications bus or through multiple wires and an output terminal 16 connected to an input terminal 32 of output assembly 30 through a multi-channel unidirectional communications bus or through multiple wires. In addition, controller 12 is connected to MMU 40 through a single wire or a multi-wire bi-directional communications connection 18 such as a single wire or a multi-wire communications bus. Output assembly 30 includes an array 36 of load switches comprising one or more load switches $\mathbf{36}_1$, $\mathbf{36}_2$, . . . , $\mathbf{36}_m$, where m is an integer that may be 1, 2, 3, etc. A bi-directional communications connection 39 connects output assembly 30 to MMU 40. Bi-directional communications connection 39 may be a single wire bidirectional communications bus or a multi-wire bidirectional communications bus. Communications busses such a single wire communications busses or multi-wire communications busses may be referred to as busses.

Output assembly 30 is connected to input 52 of flash transfer relay 50 through a single channel or a multi-channel unidirectional communications connection $\mathbf{38}R_m$, which may be a single wire communications bus or a multi-wire communications bus. Output assembly 30 is connected to inputs $\mathbf{72}Y_m$ of signal section $\mathbf{76}Y_m$ through multi-channel unidirectional communications connections $\mathbf{38}Y_m$ and to inputs $\mathbf{48}Y_m$ of MMU 40 through multi-channel unidirectional communications connections $\mathbf{38}Y_m$ and multi-channel unidirectional communications connections $\mathbf{71}Y_m$. Output assembly 30 is connected to input $\mathbf{72}G_m$ of signal section $\mathbf{76}G_m$ through multi-channel unidirectional communications connections $\mathbf{38}G_m$ and to an inputs $\mathbf{48}G_m$ of MMU 40 through multi-channel unidirectional communications connections $\mathbf{38}G_m$ and multi-channel unidirectional communications connections $\mathbf{71}G_m$. Single channel unidirectional communications connections may be referred to as single channel unidirectional communications busses or single channel communications busses and multi-channel bidirectional communications connections may be referred to as multi-channel bidirectional communications buses or multi-channel communications busses. Array 36 may communicate with the environment via an output terminal to effect traffic control via activation of the appropriate traffic signal. In this example, controller 12 communicates with and controls the various assemblies within cabinet 80. The present invention is not limited to specific controller units or communication protocols.

MMU 40 is configured to detect and respond to conflicting or otherwise improper signals caused by a malfunctioning controller 12, faulty load switches such as, for example, load switches $\mathbf{36}_1$, $\mathbf{36}_2$, . . . , $\mathbf{36}_m$, cabinet mis-wiring, improper supply voltages, or other such faulty mechanisms. MMU 40 may be configured as a 6-channel monitor, a 12-channel monitor, a 16-channel monitor, a 32-channel monitor, etc. Inputs $\mathbf{48}R_m$, $\mathbf{48}Y_m$, and $\mathbf{48}G_m$ of MMU 40 form a channel. The number of channels for MMU 40 is not a limitation of the present invention. Likewise, the number of signal heads connected to MMU 40 is not a limitation of the present invention. A traffic intersection may have one, two, three, four, or more signal heads connected to MMU 40. It should be noted that an MMU may be referred to as a signal monitor, a conflict management unit, or the like.

The general functional requirements of conventional MMU's are covered by a variety of standards including, for example, National Electrical Manufacturers Association ("NEMA") TS2-2016; Traffic Control Systems AASHTO/ITE/NEMA Intelligent Transportation Systems ("ITS"); Standard Specification for Roadside Cabinets, v 01.02.17b; and Caltrans Transportation Electrical Equipment Specifications ("TEES"), August 2009. In this regard, MMU's are often referred to in terms of which standards to which they conform, including, for example, NEMA TS-2 signal monitors, NEMA TS-1 signal monitors, 2010 signal monitors, 210 signal monitors, ITS signal monitors, etc. It will be appreciated that the present invention is not limited to any particular standard or type of signal monitor.

In accordance with an embodiment, MMU 40 includes a flash signal detection module 41 which may be comprised of any suitable combination of hardware, software, and/or non-transitory computer-readable media configured to detect the occurrence of at least two light sources from signal sections $\mathbf{76}R_m$, $\mathbf{76}Y_m$, and $\mathbf{76}G_m$ being active or on at the same time or no signal sections $\mathbf{76}R_m$, $\mathbf{76}Y_m$, and $\mathbf{76}G_m$ being active. Two or more light sources from signal sections $\mathbf{76}R_m$, $\mathbf{76}Y_m$, and $\mathbf{76}G_m$ being active at the same time, e.g., simultaneously, may occur because of physical shorting of single channel unidirectional communications busses $\mathbf{71}R_m$, $\mathbf{71}Y_m$, and $\mathbf{71}G_m$ to input terminals $\mathbf{72}R_m$, $\mathbf{72}Y_m$, and $\mathbf{72}G_m$ of signal sections 76$R_m$, 76$Y_m$, and 76$G_m$. The short circuit can occur either inside or outside of cabinet 80.

MMU 40 may be configured such that it receives and processes signals from output assembly 30 and controller 12. In this way, MMU 40 provides "field checking." That is, MMU 40 is capable of determining the output of load switches $\mathbf{36}_1$, $\mathbf{36}_2$, . . . , $\mathbf{36}_m$ while at the same time monitoring what controller 12 has instructed those outputs to be.

MMU 40 is connected to a flasher 60 through a multi-channel unidirectional communications bus 46A and to inputs $\mathbf{53}_m$ of flash transfer relay 50B through a multi-channel communications bus 46$D_m$.

In conventional MMU designs, when one or more failures occurs, the MMU instructs or, more generally, causes other components to instruct the signal sections to enter the flash mode, in which the signal head or signal heads at all sides of the intersection generally enter a flashing red state. More particularly, flash transfer relay 50A is instructed directly by MMU 40 to configure a traffic control device, such as, for example, signal head 70 to enter the flash mode.

Flash transfer relay 50A has inputs $\mathbf{54}_p$ connected to outputs $\mathbf{64}_p$ of flasher 60 through a multi-channel unidirectional communications bus, and one or more outputs 56$R_m$ connected to one or more corresponding inputs 72$R_m$ of signal section 76$R_m$ through a multi-channel unidirectional communications bus and to one or more inputs 48$R_m$ of MMU 40 through multi-channel unidirectional communications bus 71$R_m$. Thus, a control signal may be transmitted from the output of flasher 60 through flash transfer relay 50A to MMU 40 through multi-channel unidirectional communications bus 71$R_m$ and to signal section 76$R_m$ through a multi-channel unidirectional communications bus.

Figure 7:
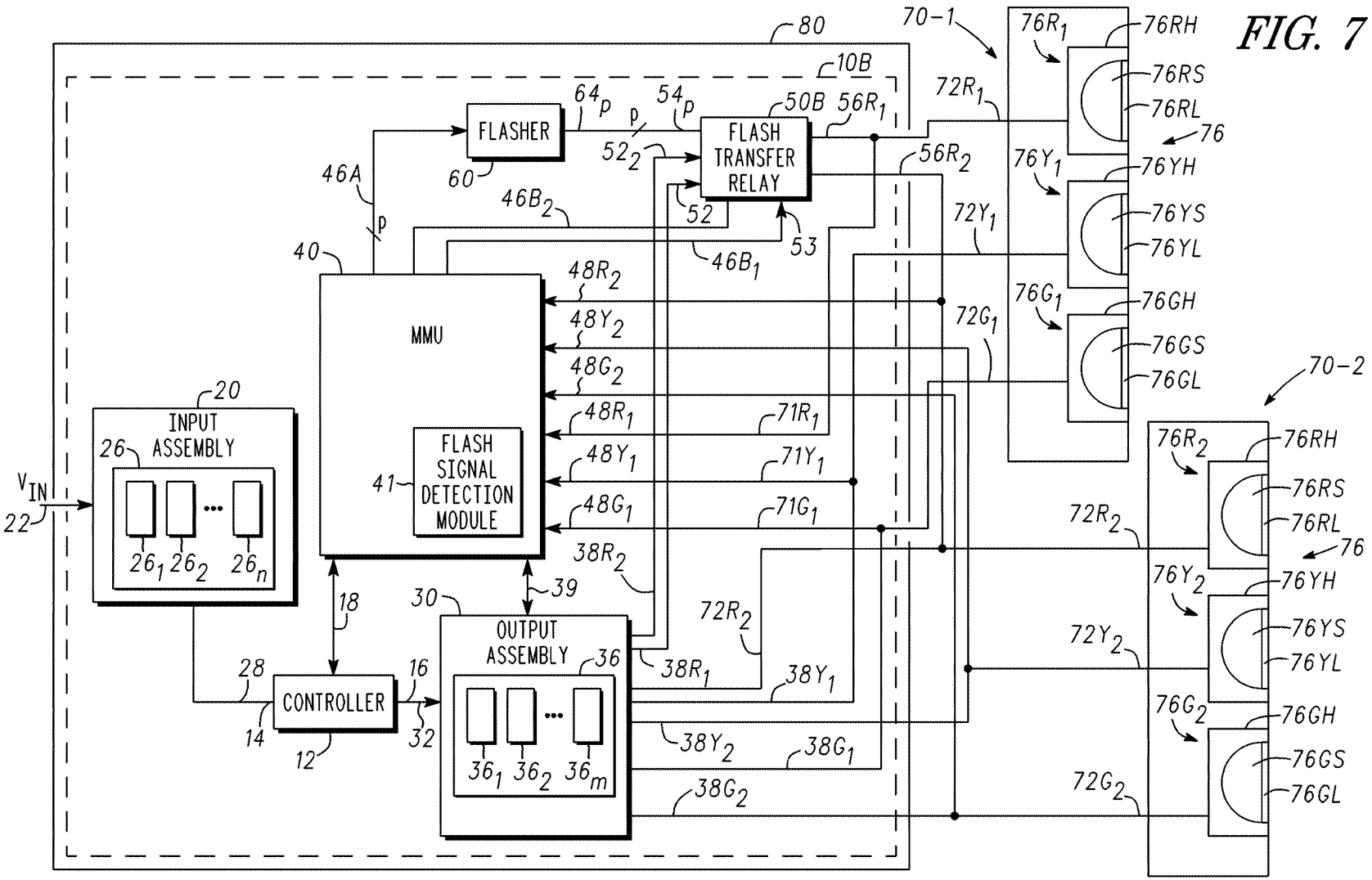
FIG. 7 is a circuit diagram of a traffic control system in accordance with an embodiment of the present invention.

FIG. 7 is a block diagram of a traffic control system 10B of FIG. 6 connected to two signal heads 70-1 and 70-2 in accordance with an embodiment in which m equals 2. Thus, traffic control system 10B controls signal heads 70-1 and 70-2.

By now it should be appreciated that an intersection control system and method for controlling traffic have been provided. In accordance with an embodiment, a method for controlling a traffic signal comprises providing a malfunction management unit that is configured to generate a control signal that disables an output of flash transfer relay 50. Accordingly, one or more of the signal heads 70 at an intersection stops transmitting traffic signals or goes dark. In an alternative embodiment, the malfunction management unit generates a control signal that opens and closes a flash disable switch. In response to the flash disable switch being open or in the open configuration, one or more of signal heads 70 at an intersection stops transmitting traffic signals or goes dark. The flash transfer relay and the flash disable switch serve as means for inhibiting a signal that causes a light source associated with at least one signal head to flash.

Although specific embodiments have been disclosed herein, it is not intended that the invention be limited to the disclosed embodiments. Those skilled in the art will recognize that modifications and variations can be made without departing from the spirit of the invention. It is intended that the invention encompass all such modifications and variations as fall within the scope of the appended claims.

What is claimed is:

1. A method for controlling a traffic signal from a signal head, comprising:

providing a malfunction management unit having an input and an output and a flasher coupled to the output of the malfunction management unit, the malfunction management unit configured to generate a control signal to be transmitted to the flasher;

generating the control signal in response to a first signal from a first light source of the signal head and a second signal from a second light source of the signal head, wherein the first signal from the first light source and the second signal from the second light source provide conflicting traffic control instructions; and using the control signal to disable the first light source and the second light source, wherein the first light source and the second light source stop emitting an output signal and an intersection under control of the signal head goes dark.

2. The method of claim 1, wherein generating the control signal in response to the first signal from the first light source and the second signal from the second light source includes generating the control signal in response to the first light source and the second light source being enabled simultaneously.

3. The method of claim 2, wherein generating the control signal includes generating the control signal to disable a flasher.

4. The method of claim 2, wherein generating the control signal includes generating the control signal to place a switch in a first operating state.

5. The method of claim 4, wherein the first operating state of the switch is an open state.

6. The method of claim 1, wherein the first light source comprises a light of a first color and the second light source comprises light of a second color.

7. The method of claim 6, wherein the first color is green and the second color is yellow.

8. The method of claim 6, wherein using the control signal to disable the first light source and the second light source includes inhibiting the first flasher and the second flasher from emitting light signals.

9. A method for operating a traffic control system, comprising:

monitoring a first operating signal and a second operating signal, the first operating signal generated in response to a light source from a first signal head and the second operating signal generated in response to a light source from a second signal head;

generating a control signal in response to the first operating signal and the second operating signal, wherein the first operating signal and the second operating signal provide conflicting traffic control instructions; and using the control signal to inactivate at least the light source from the first signal head, wherein at least the light source from the first signal head goes dark in response to being inactivated.

10. The method of claim 9, wherein using the control signal to inactivate at least the light source from the first signal head comprises configuring a flash disable switch to disable a signal to the light source from the first signal head.

11. The method of claim 10, wherein using the control signal to inactivate at least the light source from the first signal head further comprises configuring the flash disable switch to disable a signal to the light source from the second signal head.

12. The method of claim 11, wherein using the control signal to inactivate at least the light source from the second signal head comprises configuring the flash disable switch to disable a signal to the light source from the second signal head.

13. The method of claim 12, wherein the light source from the first signal source is configured to emit green light and the light source from the second signal head is configured to emit yellow light or red light.

14. The method of claim 9, further including using the control signal to interrupt a signal to the light source from the first signal head.

15. The method of claim 14, further including using the control signal to interrupt a signal to the light source from the second signal head.

16. The method of claim 9, wherein using the control signal to inactivate at least the light source from the first signal head includes opening a switch.

17. The method of claim 16, wherein using the control signal to inactivate at least the light source from the second signal head includes opening the switch.

18. A traffic control system, comprising:

a malfunction management unit having a plurality of inputs and a plurality of outputs;

a first signal head coupled to the malfunction management unit; and means to inhibit a signal that causes a first light source associated with the first signal head to flash, wherein the means to inhibit causes the first light source associated with the first signal head to go dark in response to a control signal.

19. The traffic control system of claim 18, wherein the means to inhibit the signal that causes the first signal head to flash is a switch.

20. The traffic control system of claim 19, wherein the means to inhibit the signal that causes the first signal head to flash comprises a flash transfer relay.

* * * * *